US006022494A

United States Patent [19]

Sartori et al.

[11] Patent Number: 6,022,494

[45] Date of Patent: Feb. 8, 2000

[54] PROCESS FOR DECREASING THE ACID CONTENT AND CORROSIVITY OF CRUDES

[75] Inventors: Guido Sartori, Annandale; David William Savage, Lebanon; Martin Leo Gorbaty, Westfield; Bruce Henry Ballinger, Bloomsbury; Saul Charles Blum, Edison; Michael Paul Anderson, Clinton; Trikur Anantharaman Ramanarayanan, Somerset; David J. Martella, Princeton, all of N.J.

[73] Assignee: Exxon Research and Engineering Co., Florham Park, N.J.

[21] Appl. No.: 09/011,117

[22] PCT Filed: Aug. 23, 1996

[86] PCT No.: PCT/US96/13688

§ 371 Date: Sep. 15, 1998

§ 102(e) Date: Sep. 15, 1998

[87] PCT Pub. No.: WO97/08270

PCT Pub. Date: Mar. 6, 1997

Related U.S. Application Data

[63] Continuation-in-part of application No. 08/655,261, Jun. 4, 1996, abandoned, and a continuation-in-part of application No. 08/597,310, Feb. 6, 1996, abandoned, and a continuation-in-part of application No. 08/519,554, Aug. 25, 1995, abandoned.

[51] Int. Cl.[7] ..... C09K 3/00; C10G 1/18

[52] U.S. Cl. ..... 252/387; 252/389.1; 252/389.61; 208/47; 507/939

[58] Field of Search ..... 252/387, 389.1, 252/389.61; 208/47; 507/939

[56] References Cited

U.S. PATENT DOCUMENTS

| | | | |
|---|---|---|---|
| 2,068,979 | 1/1937 | Fisher | 196/35 |
| 2,071,862 | 2/1937 | Fisher | 260/11 |
| 2,770,580 | 11/1956 | Honeycutt et al. | 196/36 |
| 2,789,081 | 4/1957 | Mills | 196/36 |
| 2,795,532 | 6/1957 | Honeycutt | 196/36 |
| 3,318,809 | 5/1967 | Bray | 252/33 |
| 3,806,437 | 4/1974 | Franse et al. | 204/190 |
| 3,847,774 | 11/1974 | Jarrell | 204/190 |
| 4,033,860 | 7/1977 | Carlson | 208/206 |
| 4,199,440 | 4/1980 | Verachtert | 208/230 |
| 4,300,995 | 11/1981 | Liotta | 208/8 LE |
| 4,647,366 | 3/1987 | Edmondson | 208/47 |
| 5,182,013 | 1/1993 | Peterson et al. | 208/348 |

FOREIGN PATENT DOCUMENTS

| | | | |
|---|---|---|---|
| 1786060 | 7/1993 | U.S.S.R. | C10G 25/00 |

OTHER PUBLICATIONS

Chemical Abstracts, 72, 113446 (abstract only). (1968).

Camp et al "Neutralization as a Means of Controlling Corrosion of Refinery Equipment", Nat'l. Association of Corros. Eng., vol. 6, pp. 39–44, 5th Ann. Conf., Texas (Apr. 1950).

Kalichevsky et al "Petroleum Refining With Chemicals", Elsevier Publishing Company, Ch. 4 (1956).

*Primary Examiner*—D. Gabrielle Brouillette
*Assistant Examiner*—Monique T. Cole
*Attorney, Agent, or Firm*—Linda M. Scuorzo

[57] ABSTRACT

The invention relates to processes for treating acidic crudes of fractions thereof to reduce or eliminate their acidity and corrosivity by addition of suitable amounts of Group IA of Group IIA oxides, hydroxides and hydrates. The process has the additional benefits of reducing materials handling problems associated with treating acidic crude oils using liquid solvents and in reducing emulsion formation.

28 Claims, 3 Drawing Sheets

T = 600 °F

T = 600 °F

PROCESS FOR DECREASING THE ACID CONTENT AND CORROSIVITY OF CRUDES

This application is a continuation-in-part of U.S. Ser. No. 655,261 now abandoned, filed Jun. 4, 1996, U.S. Ser. No. 597,310 filed Feb. 6, 1996 now abandoned and U.S. Ser. No. 519,554 filed Aug. 25, 1995 now abandoned.

FIELD OF THE INVENTION

The present invention relates to a process for decreasing the acidity and corrosivity of crudes and crude fractions containing petroleum acids.

BACKGROUND OF THE INVENTION

Many petroleum crudes with high organic acid content, such as whole crude oils containing naphthenic acids, are corrosive to the equipment used to extract, transport and process the crude, such as pipestills and transfer lines.

Efforts to minimize naphthenic acid corrosion have included a number of approaches. U.S. Pat. No. 5,182,013 refers to such recognized approaches as blending of higher naphthenic acid content oils with low naphthenic acid content oils. Additionally, a variety of attempts have been made to address the problem by replacing carbon or low alloy steels by more expensive, highly alloyed stainless steels, using corrosion inhibitors for the metal surfaces of equipment exposed to the acids, or by neutralizing and removing the acids from the oil. Some inhibitor companies have claimed that the use of specific sulfur and phosphorus based organic corrosion inhibitors can be effective in reducing corrosion by naphthenic acids. Examples of such technologies include treatment of metal surfaces with corrosion inhibitors such as polysulfides (U.S. Pat. No. 5,182,013) or oil soluble reaction products of an alkynediol and a polyalkene polyamine (U.S. Pat. No. 4,647,366), and treatment of a liquid hydrocarbon with a dilute aqueous alkaline solution, specifically, dilute aqueous NaOH or KOH (U.S. Pat. No. 4,199,440). U.S. Pat. No. 4,199,440 notes, however, that a problem arises with the use of aqueous solutions that contain higher concentrations of aqueous base. These solutions form emulsions with the oil, necessitating use of only dilute aqueous base solutions. U.S. Pat. No. 4,300,995 discloses the treatment of carbonous materials particularly coal and its products such as heavy oils, vacuum gas oil, and petroleum residua, having acidic functionalities, with a quaternary base such as tetramethylammonium hydroxide in a liquid (alcohol or water). Additional processes using aqueous alkali hydroxide solutions include those disclosed in Kalichevsky and Kobe, *Petroleum Refining With Chemicals*, (1956) Ch. 4, as well as U.S. Pat. Nos. 3,806,437; 3,847,774; 4,033,860; 4,199,440 and 5,011,579; German Patents 2,001,054 and 2,511,182; Canadian Patent 1,067,096; Japanese Patent 59-179588; Romanian Patent 104,758 and Chinese Patent 1,071,189. Certain treatments have been practiced on mineral oil distillates and hydrocarbon oils (e.g., with lime, molten NaOH or KOH, certain highly porous calcined salts of carboxylic acids suspended on carrier media). Whole crude oils were not treated.

U.S. Pat. Nos. 2,795,532 and 2,770,580 (Honeycutt) disclose processes in which "heavy mineral oil fractions" and "petroleum vapors", respectively are treated. The '532 patent further discloses that a "flashed vapors" are contacted with "liquid alkaline material" containing, inter alia, alkali metal hydroxides and "liquid oil." A mixture solely of NaOH and KOH in molten form is disclosed as the preferred treating agent, however "other alkaline materials, e.g., lime, can also be employed in minor amounts." Importantly, '532 does not disclose the treatment of whole crudes or fractions boiling at 1050 plus ° F. ($565^{+\circ}$ C.). Rather '532 treats only vapors and condensed vapors of the 1050 minus ° F. ($565^{-\circ}$ C.) fractions, that is, fractions that are vaporizable at the conditions disclosed in '532. Petroleum residua and other non-vaporizable (at '532 process conditions) fractions containing naphthenic acids would not be treatable by the process. Since naphthenic acids are distributed through all crude fractions (many of which are not vaporizable) and since crudes differ widely in naphthenic acid content the '532 patent does not provide an expectation that one would be able to successfully treat a broad slate of crudes of a variety of boiling points.

In U.S. Pat. No. 2,068,979, it is disclosed that naphthenates were used to prevent corrosion in a petroleum still. The patent teaches the addition of calcium naphthenate to petroleum to react with and scavenge strong free acids such as hydrochloric and sulfuric acids. This was intended to prevent corrosion in distillation units by those strong acids and makes no claims with respect to naphthenic acids. In fact, naphthenic acids would have been formed when the strong acids were converted to salts. Some prior art involved the addition or formation of calcium carbonate (Cheng et al., U.S. Pat. No. 4,164,472) or magnesium oxide (Cheng et al., U.S. Pat. Nos. 4,163,728 and 4,179,383, and 4,226,739) dispersions as corrosion inhibitors in fuel products and lubricating oil products, but not in whole or topped crude oil. Similarly, Mustafaev et al. (Azerb. Inst, Neft. Khim. (1971) 64–6) reported on the improved detergency and anticorrosive properties of calcium, barium, and zinc hydroxide additives in lubricating oils. Amine naphthenates (Wasson et al., U.S. Pat. No. 2,401,993) and zinc naphthenates (Johnson et al., U.S. Pat. No. 2,415,353; Rouault, U.S. Pat. No. 2,430,951; and Zisman et al., U.S. Pat. No. 2,434,978) were also claimed as anticorrosive additives in various lubricating oil products. Another use of calcium compounds with petroleum includes removal of naphthenic acids from hydrocarbon oils by limestone-on-glass abstraction (Elkin et al., Soviet Union 1,786,060) or by metal oxides related to hydrotalcites (Gillespie et al., U.S. Pat. No. 5,389,240). Finally, calcium hydroxide (Kessick, Canadian Patent 1,249,760) aids in separation of water from heavy crude oil wastes.

While these processes have achieved varying degrees of success there is a continuing need to develop more efficient methods for reducing the acidity and corrosivity of whole crudes and fractions thereof, particularly residua and other $650^{+\circ}$ F. ($343^{+\circ}$ C.) fractions.

SUMMARY OF THE INVENTION

A method for decreasing the acidity and corrosivity of an acid-containing, corrosive crude, comprising: contacting a starting acid-containing, corrosive crude oil with an effective amount of a metal-containing compound selected from the group consisting of Group IA and IIA metal oxides, hydroxides and hydroxide hydrates in the presence of a corresponding effective amount of water, to produce a treated crude oil having a decreased acidity and corrosivity.

The present invention may suitably comprise, consist or consist essentially of the elements disclosed and may be practiced in the absence of an element not disclosed.

DETAILED DESCRIPTION OF THE INVENTION

Figure 1:
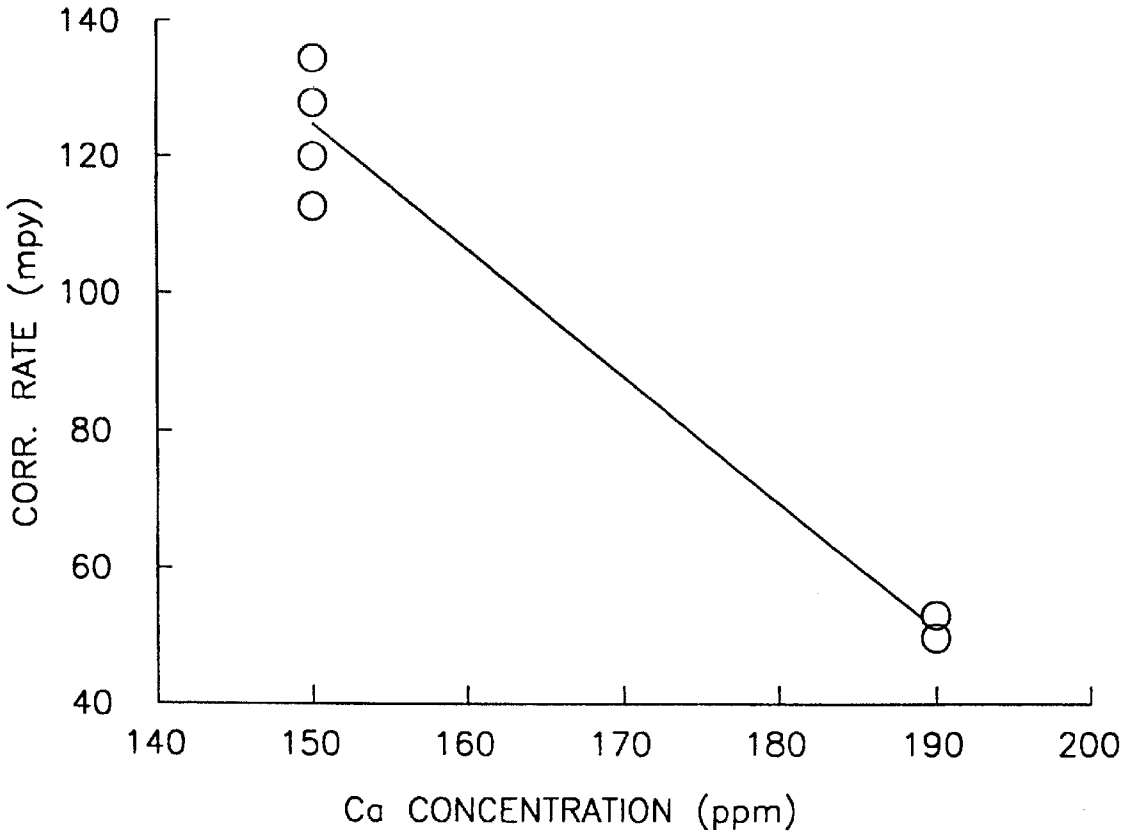
FIG. 1 shows the corrosion rate of a crude oil as a function of Ca concentration for Example 7.

Some whole crude oils contain organic acids such as carboxylic acids that contribute to corrosion or fouling of refinery equipment. These organic acids generally fall within the category of naphthenic and other organic acids. Naphthenic acid is a generic term used to identify a mixture of organic acids present in petroleum stocks. Naphthenic acids can cause corrosion at temperatures ranging from about 65° C. (150° F.) to 420° C. (790° F.). Naphthenic acids are distributed through a wide range of boiling points (i.e., fractions) in acid containing crudes. The present invention provides a method for broadly removing such acids, and most desirably from heavier (higher boiling point) and liquid fractions in which these acids are often concentrated. The naphthenic acids may be present either alone or in combination with other organic acids, such as phenols.

Whole crude oils are very complex mixtures in which a large number of competing reactions may occur. Unexpectedly, the reactions occur although the acid is dilute in comparison to the large excess of crude and other reactive species typically present. And desirably the resulting naphthenate salts remain oil soluble and tend to concentrate in the residual rather than concentrating in lower boiling point side streams.

The process of the present invention has utility in processes in which inhibiting or controlling liquid phase corrosion, e.g., of metal surfaces, is desired. More generally, the present invention may be used in applications in which a reduction in the acidity, typically, as evidenced by a decrease in the neutralization number of the acidic crude or a decrease in intensity of the carboxyl band in the infrared spectrum at about 1708 $cm^{-1}$ of the treated (neutralized) crude, would be beneficial and in which oil-aqueous emulsion formation and large solvent volumes are not desirable. The present invention also provides a method for controlling emulsion formation in acid crudes, by treating a major contributing component of such emulsions, naphthenic and similar organic acids, and by reducing the attendant handling and processing problems.

The concentration of acid in the crude oil is typically expressed as an acid neutralization number or acid number, which is the number of milligrams of KOH required to neutralize the acidity of one gram of oil. It may be determined according to ASTM D-664. Typically, the decrease in acid content may be determined by a decrease in the neutralization number or in the intensity of the carboxyl band in the infrared spectrum at about 1708 $cm^{-1}$. Crude oils with total acid numbers (TAN) of about 1.0 mg KOH/g and lower are considered to be of moderate to low corrosivity (crudes with a total acid number of 0.2 or less generally are considered to be of low corrosivity). Crudes with total acid numbers greater than 1.5 are considered corrosive. Acidic crudes having free carboxyl groups may be effectively treated using the process of the present invention. The IR analysis is particularly useful in cases in which a decrease in neutralization number is not evident upon treatment with the base as has been found to occur upon treatment with bases weaker than KOH.

The crudes that may be used are any naphthenic acid-containing crude oils that are liquid or liquefiable at the temperatures at which the present invention is carried out. As used herein the term whole crudes means unrefined, undistilled crudes.

As used herein the term stoichiometric amount means a sufficient amount of metal oxide, hydroxide or hydroxide hydrate on a molar basis to neutralize a mole of acidic functionality in the crude oil. In moles, in the case of Group IA oxides, hydroxides and hydroxide hydrates the ratio is 1:1 moles of metal to acid functionality; for Group IIA oxides and hydroxides the ratio is 0.5 to 1 moles of metal to acid functionality. The terms "above," "greater than" or "in excess of" stoichiometric are defined in relation to the foregoing, as is the term "substoichiometric." Substoichiometric ranges from 0.025:1 moles up to a stoichiometric amount, preferably 0.25:1 to less than 0.5:1 (i.e., a stoichiometric amount) for Group IIA; for Group IA it is 0.05:1 moles to less than 1:1 (i.e., a stoichiometric amount) preferably 0.5:1 to less than 1:1 moles. Greater than stoichiometric can range up to 10:1 moles for Group IA and IIA, preferably up to 5:1 for Group IIA. Preferred metals are sodium, lithium and potassium for Group IA, and calcium, magnesium, barium and strontium for Group IA, with calcium and magnesium preferred, and calcium most preferred.

The contacting is typically carried out at either ambient temperature or at an elevated temperature sufficient to reflux the solution. Typically, this range is up to 200° C., with narrower ranges suitably from about 20° C. to 200° C., preferably 50° C. to 200° C., more preferably 75° C. to 150° C.

Corrosive, acidic crudes, i.e., those containing naphthenic acids alone or in combination with other organic acids such as phenols may be treated according to the present invention.

The acidic crudes are preferably whole crudes. However, acidic fractions of whole crudes such as topped crudes and other high boiling point fractions also may be treated. Thus, for example, 500° F. (260° C.) fractions, $650^{+\circ}$ F. ($343^{+\circ}$ C.) fractions, vacuum gas oils, and most desirably $1050^{+\circ}$ F. ($565^{+\circ}$ C.) fractions and topped crudes may be treated.

1. Oxide, Hydroxide and Hydroxide Hydrate Treatment

In one aspect of the invention the crude is contacted with an effective amount of a Group IA or Group IIA metal-containing compound, i.e., alkali metal or alkaline-earth metal oxide, hydroxide or hydroxide hydrate in the presence of an effective amount of water, which when present may be added or naturally occurring, to produce a treated crude having a decreased corrosivity and acidity. The material is added as a solid, which also may include a solid-in-liquid slurry, solid-in-water or solid-in-organic liquid slurry or aqueous suspension. The processes of the present invention may be used to produce treated crudes having a decreased corrosivity and naphthenic acid content which either are fully-neutralized or partially neutralized depending on the ratio and type of oxide, hydroxide or hydroxide hydrate used to treat the acid crude. The Group IA and IIA metal oxide and mixtures or hydroxide and mixtures or hydroxide hydrate and mixtures thereof, is added to the acid containing crude in a molar ratio effective to produce a neutralized or partially neutralized (i.e., non-corrosive) crude oil; neutralization may be in whole or partial as desired. The corrosion reduction and decrease in acidity is influenced by the amount of oxide, hydroxide or hydroxide hydrate added. Broadly, the range of addition is from a substoichiometric amount to 10:1 moles per mole of acid. More specifically, it may be added in a ratio of Group IA metal oxide or mixtures, hydroxide or mixtures, or hydroxide hydrate or mixtures of from 0.05 moles to less than 1:1 moles per mole of acid, from 0.5:1 to less than 1:1 moles, 1:1 to 10:1. For Group IIA the range can be lower. Typically ratios of Group IIA metal oxide or mixtures, hydroxide or mixtures or hydroxide hydrate or mixtures to total acid of from 0.025 moles up to a stoichiometric amount, or from 0.25 moles to less than a stoichiometric amount, up to 10:1 moles, but ratios of from 0.5:1 to about 5:1, and from 1:1 to 0.5:1 also may be used. The addition of smaller amounts (than stoichiometric) of Group IA or Group IIA metal oxides, hydroxides or hydroxide hydrates may result in an incomplete (i.e., partial) neutralization of the starting acid crude. Preferred are CaO and $Ca(OH)_2$.

Some crudes themselves contain a sufficient amount of water, others require water addition to the ranges specified herein. The total amount of water is an effective amount of from zero to 7 wt % of the crude. The total amount of water for Group IIA metal containing compounds ranges from at least 0.3 wt % (based on acid-containing oil), more preferably 0.3 wt % to 7 wt %, but can fall within the following ranges 0.2–1.5 weight %, 0.3–1.2% and 0.6–1%. When Group IA metal oxides, hydroxides and hydroxide hydrates are used, they do not require addition of water but can be used either in the absence or in the presence of water within the specified ranges for Group IIA. The treatments produce treated crudes having a decreased corrosivity and reduced acidity that may range from partial neutralization to essential absence of acidity depending on the treatment. Anhydrous acidic crudes may be treated by contacting the crude with an effective amount of metal containing compound, selected from the Group IIA metal oxides, hydroxides, hydroxide hydrates or mixtures of oxides, hydroxides or hydroxide hydrates in the presence of a corresponding sufficient amount of water to render the base effective for neutralizing acid. Thus a small amount of water must be present for the reaction to be effective when Group IIA metal oxides, hydroxides and hydroxide hydrates are used.

The formation of a crude oil-aqueous (i.e. either water-in-oil or oil-in-water) emulsion tends to interfere with the efficient separation of the crude oil and water phases and thus with recovery of the treated crude oil. Emulsion formation is undesirable and a particular problem that is encountered during treatment of naphthenic acid-containing crudes with aqueous bases. The processes of the present invention can be carried out in the essential absence of emulsion formation. Thus, an additional benefit of the treatment is the absence or substantial absence of emulsion formation.

The Group IA and IIA metal oxides, hydroxides and hydroxide hydrates may be purchased commercially or synthesized using known procedures. In solid form, they may be in the form of a powder or a composite, sized particle or supported on a refractory (ceramic) matrix. Typical hydroxides include KOH, NaOH, calcium hydroxide, lithium hydroxide monohydrate and barium hydroxide octahydrate, while oxides include calcium oxide, sodium oxide and barium oxide. Preferred are calcium oxide and hydroxide. Certain of the solids typically occur as crystals of the hydrate.

Reaction times depend on the temperature and nature of the crude to be treated, its acid content and the amount and type of Group IA or IIA metal oxide, hydroxide hydrate added, but typically may be carried out for from less than about 1 hour to about 20 hours to produce a product having a decrease in corrosivity and acid content. The treated crude contains naphthenate salts of the corresponding Group IA or IIA metal oxide, hydroxide or hydroxide hydrate used in treatment.

2. Naphthenic Acid Salt Treatment

In another aspect of the invention to reduce the corrosivity of crude oils, corrosivity and acidity decrease is achieved by processes that include the direct addition or the in situ generation of metal carboxylates in corrosive crudes. Metal carboxylates whose thermodynamic stability is equal to or exceeds the stability of iron carboxylates are useful in this invention. Preferred metals belong to the alkaline earth class, namely, Ca, Mg, Ba and Sr.

The starting acid crude oils for naphthenic acid salt treatment have a water content at least 0.3 wt.%, more preferably said water content is between 0.3 wt % and 7 wt %.

For direct addition, the metal naphthenate salt is added in an effective amount of up to 5:1 moles of metal to acidic functionality in the crude oil. Specifically in this aspect of the invention the corrosivity of an acid-containing, corrosive crude is decreased by contacting a starting acid-containing, corrosive crude oil with an effective amount of a naphthenate salt selected from the group consisting of Group IIA metal naphthenate full and partial salts (such as half salts). Additionally, the metal naphthenate salt may be added by blending a starting acid-containing crude oil with a second, metal naphthenate-containing crude oil or fraction ("treating crude oil"). The metal naphthenate salts are made in situ as disclosed in "1. Oxide, Hydroxide and Hydroxide Hydrate Treatment" and in this section. The neutralized crude may be fully or partially neutralized depending on the ratio of metals to acidic functionality used to produce it. The metals are Group IA and Group IIA metals as discussed previously. Treating crudes containing an effective amount of naphthenate salt are used, but practically this means that the ratio of metal naphthenate in the treating crude to acid in the starting, acid-containing crude will be less than 1:1 moles. However, in practice, a naphthenate salt having a range of 0.025:1 to 1:1 moles of metal based on acid content of the staring acidic crude, more typically 0.25 to 1:1 moles is used. Ratios of greater than 1:1 moles and typically to 10:1 moles metal to acid content may also be used, however, naphthenate salt in excess of that produced by in situ neutral on in the treating crude may need to be added. Thus acidity and corrosivity reduction of the starting crude may be achieved to the desired degree by altering the ratio of starting acid-containing crude to naphthenate salt generated by in situ addition, or by direct addition and/or blending with the second, naphthenate-containing (i.e., neutralized) crude. The starting acidic crude and the second, naphthenate-containing crude should have comparable boiling point ranges and characteristics. Thus, for example, an acidic whole crude should be blended with a naphthenate containing whole crude, a $500^{\circ+}$ F. ($260^{\circ+}$ C.) fraction with a corresponding fraction, a $650^{\circ+}$ F. ($343^{\circ+}$ C.) fraction with a corresponding fraction, a $1050^{\circ+}$ F. ($565^{\circ+}$ C.) fraction with a corresponding fraction, a vacuum gas oil with a corresponding vacuum gas oil, a topped crude with a comparable topped crude and the like.

Broadly stated when in situ generation is practiced, the process involves adding a metal oxide or hydroxide to a starting acid-containing crude oil in substoichiometric amounts to form the corresponding naphthenate. Thus in another aspect, an alkaline-earth metal oxide, in particular, CaO or calcium hydroxide, is added in substoichiometric amounts to the crude oil which contains carboxylic acids, in particular, naphthenic acid. By this, is meant that less CaO or calcium hydroxide is added than needed to fully neutralize the acids.

While not wishing to be bound by a particular theory, it is believed that substoichiometric Ca addition may suppress corrosion two ways (1) initial neutralization of some naphthenic acids, and (2) suppression of $H^+$ in remaining acids by the common ion effect. Ca reacts preferentially with stronger naphthenic acids.

The hypothesis for Ca effect on corrosion is given below.

The hydrogen ion ($H^+$) is believed as one driver for the corrosion reaction:

$$Fe^{O}+2H^{+}\rightarrow Fe^{++}+H_2$$

The CaO reaction with naphthenic acid requires and also produces $H_2O$ according to $$CaO+2RCOO—H\longrightarrow(RCOO)_2—Ca+H_2O.$$

Then with some $H_2O$ present, weakly ionized naphthenic acids are a $H^+$ source according to $$RCOO—H\rightarrow H^{+}+RCOO^{-}$$

The Ca naphthenates form additional naphthenate ions (next equation) to shift the acid equilibrium to the left, diminishing the $H^+$ concentration by the common ion effect.

$$(RCOO)_2—Ca\rightarrow(RCOO)—Ca^{+}+RCOO^{-}\rightarrow Ca^{++}+2RCOO^{-}$$

This results in a disproportionate $H^+$ concentration decrease if the salt dissociation is greater than acid dissociation.

Beneficially, emulsion formation can be reduced or essentially absent in the foregoing treatments.

The present invention may be demonstrated with reference to the following non-limiting examples.

EXAMPLE 1

The reaction apparatus was a 200-ml, fluted glass vessel, equipped with stirrer and reflux condenser. Gryphon crude (150 g), having a total acid number of 4 mg KOH/g, were put into the reactor. 150 g of Gryphon contain 10.7 milliequivalents of acids. 300 mg of calcium oxide, corresponding to 5.35 millimoles or 10.7 milliequivalents, were added. Then the mixture was brought to 100° C. and stirred for 7 hours. Infrared examination showed no change in the bands at 1708 $cm^{-1}$ and 1760 $cm^{-1}$, corresponding to the dimeric and monomeric forms of the acid, as compared to untreated Gryphon. 1.5 ml of water was added. After 30 minutes, infrared examination showed that the bands at 1708 and 1760 $cm^{-1}$ had disappeared, i.e. the acids were neutralized.

EXAMPLE 2

The reaction apparatus was the same as in Example 1. 50 g of Heidrun crude, having a total acid number of 2.8 mg KOH/g, were put into the reactor. 50 g of Heidrun contain 2.5 milliequivalents of acids. 70 mg of calcium oxide, corresponding to 1.25 millimoles or 2.5 milliequivalents, were added. Then the mixture was stirred at 100° C. for 7 hours. Infrared examination showed no change in the intensity of the bands at 1708 and 1760 $cm^{-1}$, corresponding to the dimeric and monomeric forms of the acids, as compared to untreated Heidrun. 0.5 ml of water was added and the mixture was stirred at 100° C. for 30 minutes. Infrared examination showed that the bands at 1708 and 1760 $cm^{-1}$ had disappeared, i.e. the acids had been neutralized.

EXAMPLE 3

The reaction apparatus was a 300-ml glass reactor, equipped with stirrer, Dean-Stark trap and reflux condenser. 200 ml of San Joaquin Valley crude, having a total acid number of 4.2 mg KOH/g, were put into the reactor and heated at 120° C. until no more water condensed in the Dean-Stark trap, which took about 4 hours. 100 g of the anhydrous San Joaquin Valley crude so obtained were put into the reactor used in Example 1. 100 g of San Joaquin Valley crude contain 7.5 milliequivalents of acids. 210 mg of calcium oxide, corresponding to 3.75 millimoles or 7.5 milliequivalents, were added to the crude. Then the mixture was stirred at 100° C. for 5 hours. Infrared examination showed no change in intensity of the bands at 1708 and 1760 $cm^{-1}$, corresponding to the dimeric and monomeric forms of the acid, as compared to untreated San Joaquin Valley crude. 1 ml of water was added. After stirring at 100° C. for 30 minutes, infrared examination showed that the bands at 1708 and 1760 $cm^{-1}$ had disappeared, showing neutralization of the acids.

EXAMPLE 4

The reaction apparatus was a 300-ml glass vessel, equipped with stirrer, Dean-Stark trap and reflux condenser. 200 g of Bolobo 2/4, having a total acid number of 8.2 mg KOH/g, were put into the reactor and heated at 150° C. until no more water condensed in the Dean-Stark trap. That took about 4 hours. 100 g of anhydrous Bolobo 2/4 so obtained were put into the same reactor as used in Example 1. 100 g of Bolobo 2/4 contain 14.6 milliequivalents of acids. 410 mg of calcium oxide, corresponding to 7.3 millimoles or 14.6 milliequivalents, were added. The mixture was stirred at 100° C. for 4 hours. Infrared examination showed no change in the intensity of the bands at 1708 and 1760 $cm^{-1}$, corresponding to the dimeric and monomeric forms of the acids, as compared to untreated Bolobo 2/4. 1 ml of water was added and the mixture was stirred at 100° C. for 30 minutes. Infrared examination showed that the bands at 1708 and 1760 $cm^{-1}$ had disappeared, showing neutralization of the acids.

EXAMPLE 5 (COMPARATIVE)

This example is for comparison, i.e. to show that alkali metal hydroxides do not require water addition in order to react with the acids of a dry crude. The reaction apparatus was the same as in Example 1. 100 g of Gryphon crude, having a total acid number of 4 mg KOH/g, were put into the reactor. 100 g of Gryphon contain 7.14 milliequivalents of acids. 286 mg of sodium hydroxide, corresponding to 7.14 milliequivalents, were added. Then the mixture was heated at 100° C. for 3 hours. Infrared examination showed that the peaks at 1708 and 1760 $cm^{-1}$, corresponding to the dimeric and monomeric forms of the acids, had virtually disappeared, indicating essentially complete neutralization.

EXAMPLE 6 (COMPARATIVE)

This example is for comparison, i.e. to show that alkali metal oxides do not require water addition to react with the acids of a dry crude. The reaction apparatus was the same as in Example 1. 100 g of Gryphon crude were put into the reactor. Then 221 mg of sodium oxide, corresponding to 3.57 millimoles or 7.14 milliequivalents, were added. The mixture was heated at 100° C. for 2 hours. Infrared examination showed that the peaks at 1708 and 1760 $cm^{-1}$, corresponding to the dimeric and monomeric forms of the acids, had virtually disappeared, indicating essentially complete neutralization.

EXAMPLE 7

250 gms. of crude oil having a high naphthenic acid (total acid number=8 mg KOH per gm of oil) content were placed in a corrosion testing autoclave. The corrosion rate of carbon steel in the crude oil was measured at a temperature of 600° F. (316° C.) and gave a value of ~125 mils per year (mpy). The crude contained a calcium concentration of ~150 ppm. Then, to a fresh batch of 250 gms. of the same crude oil, calcium naphthenate was added so that the calcium content in the mixture changed to a value of 190 ppm. The corrosion rate of carbon steel was remeasured in this mixture. As shown in FIG. 1, the corrosion rate was found to be a factor of 2.5 lower. The disproportionate decrease in corrosion rate is attributed to corrosion inhibition by the Ca naphthenates.

EXAMPLE 8

Figure 2:
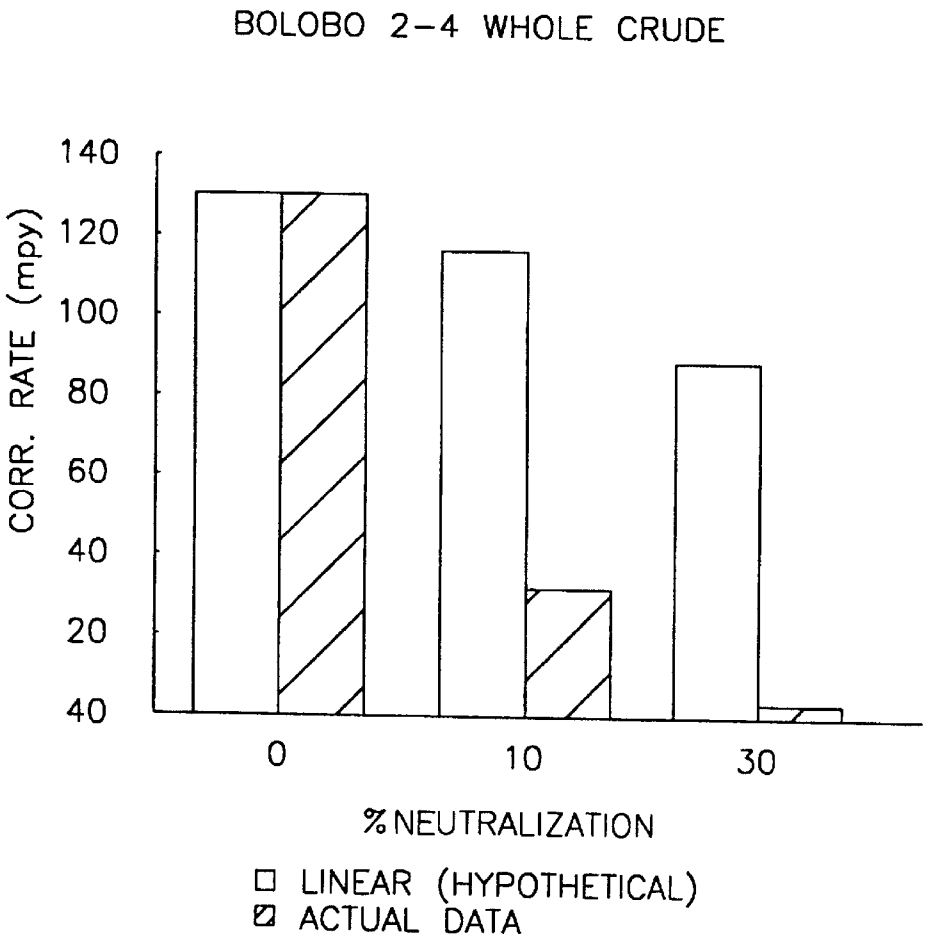
FIG. 2 shows the corrosion rate for the crude oil versus % naphthenic acid neutralization for Example 8.

The naphthenic acid content in the starting high TAN crude described in Example 1 was fully neutralized by treatment with a stoichiometric amount of CaO at a temperature of 210° F. (98.9° C.). The virgin high TAN crude was then mixed with the fully neutralized crude in weight ratios of 9:1 and 7:3, respectively. The corrosion rate of carbon steel in the two blends was measured at a temperature of 600° F. (316° C.). The results are shown as the black bars in FIG. 2. The corrosivity of the 9:1 blend (10% neutralized) is a factor of 6 lower when compared to the virgin crude and that of the 7:3 blend (30% neutralized) is a factor of 50 lower. Had only neutralization occurred without synergistic corrosion inhibition, a linear decrease in corrosion rate, proportional to the degree of neutralization, would have resulted as illustrated by the shaded bars in FIG. 2. The larger decrease in measured corrosion rates is further evidence of corrosion inhibition by metal carboxylates formed during neutralization.

EXAMPLE 9

Figure 3:
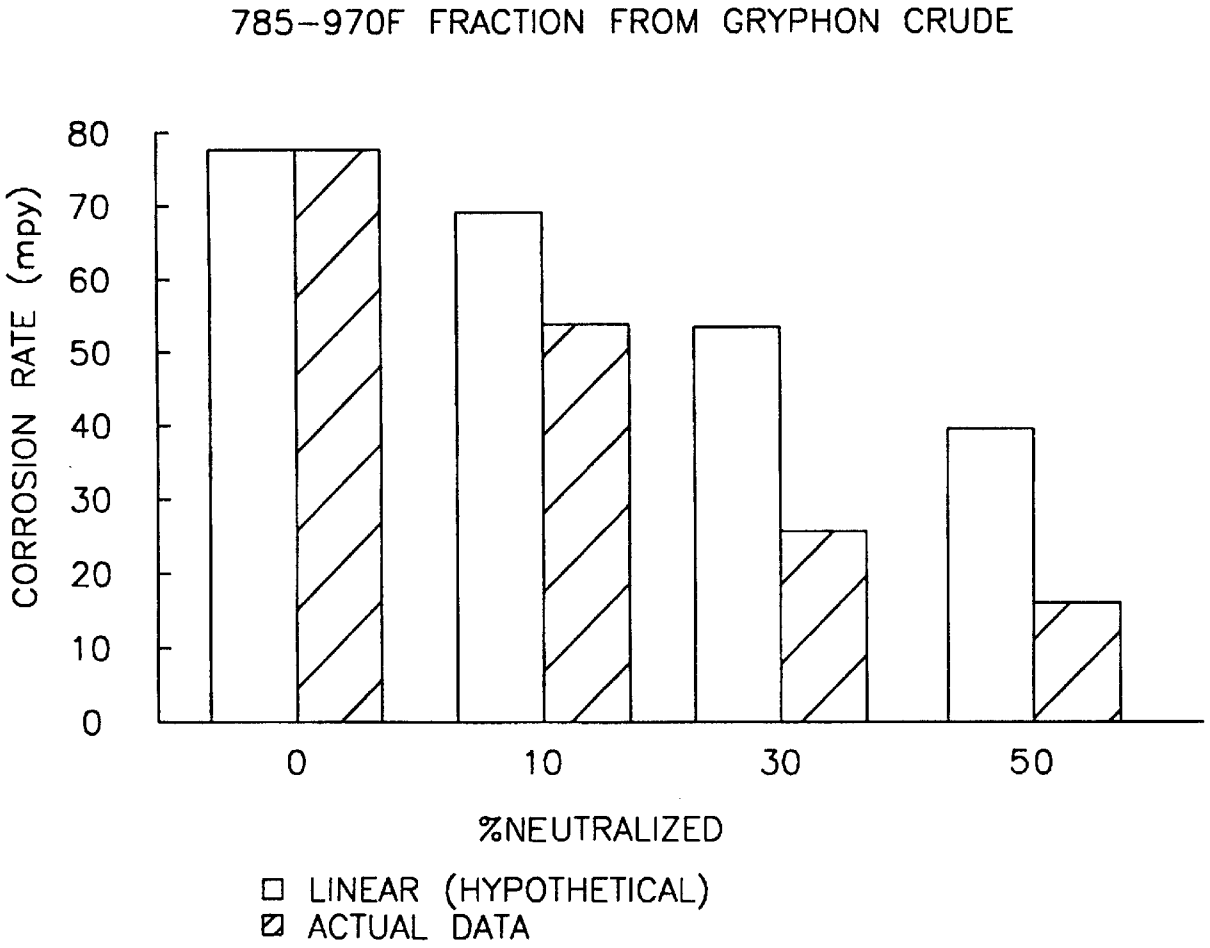
FIG. 3 shows the corrosion rate for a 785–970° F. (418–521° C.) crude oil fraction versus % naphthenic acid neutralization for Example 9.

This is similar in concept to Example 8 except that a 785–970° F. (418–521° C.) distillate fraction obtained from Gryphon crude was used as the starting material. Again, corrosion tests were performed at 600° F. (316° C.) with separate fractions of this sample neutralized at 10, 30, and 50% with CaO. Here, up to an 80% reduction in corrosion rate at 50% neutralization was measured (black bars in FIG. 3), with each measurement exceeding the hypothetical (shaded bars) results if corrosion reduction were proportional to the degree of neutralization.

EXAMPLE 10

The reaction apparatus was a flask, equipped with mechanical stirrer and reflux condenser, immersed in an oil bath. 50 g of San Joaquin Valley crude, having a neutralization number of 4.17 mg KOH/g, and 208 mg of finely ground potassium hydroxide were put into the flask. The oil bath temperature was increased to 100° C. and kept there for 5 hours, with vigorous agitation of the flask content. After cooling, solids were separated by centrifugation. The crude was analyzed and found to have a neutralization number of 1.09 mg KOH/g.

EXAMPLE 11

The reaction apparatus was the same as that used in Example 10. 50 g of San Joaquin Valley crude and 150 mg of finely ground sodium hydroxide were put into the flask. The oil bath was brought to 100° C. and kept there for 6 hours with intensive agitation of the flask content. After cooling, solids are separated by centrifugation. The treated crude had a neutralization number of 1.02 mg KOH/g.

EXAMPLE 12

The reaction apparatus was the same as described in Example 10. 50 g of San Joaquin Valley crude and 300 mg of finely ground sodium hydroxide were put into the flask. The oil bath was brought to 100° C. and kept there for 8 hours, while vigorously stirring the flask content. After cooling, solids were separated by centrifugation. The treated crude had a neutralization number of 0.39 mg KOH/g.

EXAMPLE 13

The reaction apparatus was the same as described in Example 10. 50 g of San Joaquin Valley crude and 156 mg of finely ground lithium hydroxide monohydrate were put into the flask. The oil bath was heated to 100° C. and kept there for 6 hours, with intensive agitation of the flask content. After cooling, solids were separated by centrifugation. The treated crude had a neutralization number of 1.30 mg KOH/g.

EXAMPLE 14

The reaction apparatus was the same as described in Example 10. 50 g of San Joaquin Valley crude and 580 mg of barium hydroxide octahydrate were put into the flask. The oil bath was heated to 100° C. and kept there for 6 hours, while vigorously stirring the flask contents. After cooling, solids were separated by centrifugation. The treated crude had a neutralization number of 1.37 mg KOH/g, which corresponds to 31% of the original acidity still being present. However, examination by infrared spectroscopy showed that the band at 1708 $cm^{-1}$, corresponding to the carboxyl group, had an intensity which was only 12% of that of the untreated crude.

EXAMPLE 15

The reaction apparatus was a flask equipped with stirrer and reflux condenser, immersed in an oil bath. 50 g of San Joaquin Valley crude, having a neutralization number of 4.17 mg KOH/g, and 0.566 g of barium oxide were put into the flask. The oil bath temperature was brought to 100° C. and kept there for 6 hours. After cooling, the solids were separated by centrifugation. The treated crude was analyzed and found to have a neutralization number of 0.24 mg KOH/g.

EXAMPLE 16

The reaction apparatus is the same as in Example 15. 50 g of the same crude used in Example 15 and 0.23 g of sodium oxide were put into the flask. The oil bath was heated to 100° C. and kept there for 6 hours. After cooling, the solid was separated by centrifugation. The treated crude was analyzed and found to have an immeasurably low neutralization number.

EXAMPLE 17

The reaction apparatus was the same as that described in Example 10. 50 g of San Joaquin Valley crude and 490 mg of strontium hydroxide octahydrate were put into the flask. The oil bath was heated to 100° C. and kept there for 8 hours while vigorously stirring the flask content. After cooling, solids were separated by centrifugation. The treated crude had a neutralization number of 3.20 mg KOH/g. That corresponded to 76% of the original acidity. However, examination by infrared spectroscopy showed that the band at 1708 $cm^{-1}$, corresponding to the carboxyl group, had an intensity which was only 36% of that of the untreated crude.

EXAMPLE 18

The reaction apparatus was the same as in Example 10. 175 g of Bolobo 2/4 crude having a neutralization number of 8.2 mg KOH/g and 3.9 g of barium oxide were put into the reactor. The bath oil temperature was brought to 100° C. and the reactor contents were stirred for 8 hours. After cooling, solids were separated by centrifugation. The oil had a neutralization number of 1.08 mg KOH/g.

EXAMPLE 19

The reaction apparatus was the same as in Example 10. 50 g of the same crude used in Example 10 and 1.04 g of calcium oxide were put into the reactor. The oil bath was heated to 100° C. and kept there for 8 hours. After cooling, solids were separated by centrifugation. The treated crude had a neutralization number of 3.4 mg KOH/g. That corresponded to 81% of the original acidity still being present. However, examination by infrared spectroscopy showed that the band at 1708 $cm^{-1}$, corresponding to the carboxyl group, had an intensity which was only 30% of that of the untreated crude.

EXAMPLE 20

The reaction apparatus was the same as in Example 10. 50 g of the same crude used in Example 10 and 2.08 g of calcium oxide were put into the reactor. The oil bath was heated to 100° C. and kept there for 6 hours. After cooling, solids were separated by centrifugation. The treated crude had a neutralization number of 2.3 mg KOH/g, corresponding to 55% of the original acidity still being present. However, examination by infrared spectroscopy showed that the band at 1708 $cm^{-1}$, corresponding to the carboxyl group, had an intensity which was only 9% of that of the untreated crude.

EXAMPLE 21

The reaction apparatus was the same as in Example 10. 50 g of Bolobo 2/4 crude, having a neutralization number of 8.2 mg KOH/g, and 0.42 g of calcium oxide were put into the reactor. The oil bath was brought to 100° C. and kept there for 7 hours. After cooling, solids were separated by centrifugation. The treated crude had a neutralization number of 5.9 mg KOH/g, corresponding to 72% of the original acidity still being present. However, examination by infrared spectroscopy showed that the band at 1708 $cm^{-1}$, corresponding to the carboxyl group, had virtually disappeared.

EXAMPLE 22

The reaction apparatus was a glass column of 1 cm internal diameter and 37 cm height, filled with 100 g of barium oxide and heated to about 120° C. 96.2 g of Bolobo 2/4 crude, having a neutralization number of 8.2 mg KOH/g, were passed through the column. The crude so treated had a neutralization number of 1.7 mg KOH/g, corresponding to 24% of the original acidity still being present. However, examination by infrared spectroscopy showed that the band at 1708 $cm^{-1}$, corresponding to the carboxyl group, had an intensity which was only 5% of that of the untreated crude.

EXAMPLE 23

The reaction apparatus was a 200 ml flask, equipped with stirrer and reflux condenser. 100 g of a North Sea Blend, having a neutralization number of 2.1 mg KOH/g, 1 ml of water and 137 mg of $Ca(OH)_2$ were loaded into the reactor and stirred at 100° C. for 5 hours. Infrared examination showed that the band at 1708 $cm^{-1}$, corresponding to the carboxyl group, had virtually disappeared.

EXAMPLE 24

The reaction apparatus was a 100 ml flask, equipped with stirrer and reflux condenser. 50 g of a Bolobo 2/4, having a neutralization number of 8.2 mg KOH/g, and 302 mg of magnesium oxide were put into the reactor. The mixture was stirred at 100° C. for 7 hours. Infrared examination showed that the band at 1708 $cm^{-1}$, corresponding to the carboxyl group, had virtually disappeared.

What is claimed is:

1. A method for decreasing the acidity and corrosivity of an acid-containing, corrosive crude, comprising:

contacting a starting acid-containing, corrosive crude oil with an effective amount of from a less than a stoichiometric amount to 10:1 moles per mole of acid of a solid metal-containing compound selected from the group consisting of Group IA and IIA metal oxides, hydroxides and hydroxide hydrates in the presence of a corresponding effective amount of water of from zero to 7 wt % of the crude for Group IA and from 0.3 wt % to 7 wt % of the crude for Group IIA, to produce a treated crude oil having a decreased acidity and corrosivity.

2. The method of claim 1 wherein the metal containing compound is selected from the group consisting of Group IA metal oxides, hydroxides and hydroxide hydrates.

3. The method of claim 2 wherein the effective amount of metal-containing compound is from a less than a stoichiometric amount to 10:1 moles based on acid content of the starting crude oil.

4. The method of claim 2 wherein the effective amount of metal-containing compound is from 0.05:1 to less than a stoichiometric amount.

5. The method of claim 2 wherein the effective amount of metal-containing compound is from 0.5:1 to less than a stoichiometric amount.

6. The method of claim 2 wherein the effective amount of metal-containing compound is from a stoichiometric amount to 10:1 moles.

7. The method of claim 2 wherein the solid metal-containing compound is added as a and a solid-in-liquid slurry.

8. The method of claim 2 wherein the effective amount of water is from 0.3 to 7 wt % of the acid-containing crude oil.

9. The method of claim 1 wherein the metal is selected from the group consisting of Group IIA metal oxides, hydroxides and hydroxide hydrates.

10. The method of claim 9 wherein the metal-containing compound is selected from the group consisting of magnesium and calcium oxide, hydroxide and hydroxide hydrate.

11. The method of claim 9 wherein the metal-containing compound is selected from the group consisting of CaO and calcium hydroxide.

12. The method of claim 9 wherein the effective amount of metal-containing compound is from a substoichiometric amount to 10:1 moles based on acid content of the starting crude oil.

13. The method of claim 9 wherein the effective amount of metal-containing compound is from 0.025:1 moles to less than a stoichiometric amount.

14. The method of claim 9 wherein the effective amount of metal-containing compound is from 0.25:1 to less than a stoichiometric amount.

15. The method of claim 9 wherein the effective amount of metal-containing compound is from a stoichiometric amount to 10:1.

16. The method of claim 9 wherein the crude oil is an anhydrous crude oil.

17. The method of claim 9 wherein the effective amount of metal-containing compound is less than a stoichiometric amount and the effective amount of water is at least 0.3 wt %.

18. The method of claim 1 wherein the contacting temperature is from 20° C. to 200° C.

19. The method of claim 1 wherein the starting crude oil is a whole crude.

20. The method of claim 1 wherein the starting crude oil is a crude fraction.

21. The method of claim 1 wherein the starting crude oil is crude fraction having a boiling point of $650^{+\circ}$ F. ($343^{+\circ}$ C.).

22. The method of claim 1 wherein the starting crude oil is a crude fraction having a boiling point of $1050^{+\circ}$ F. ($565^{+\circ}$ C.).

23. The method of claim 1 wherein the starting crude oil is a vacuum gas.

24. The method of claim 1 wherein the starting crude oil is a topped crude.

25. The method of claim 1 wherein the starting acid-containing crude oil is a naphthenic acid-containing crude oil.

26. The method of claim 1 wherein the starting acid-containing crude oil has a neutralization number of from 0.2 to 10 mg KOH/g.

27. The method of claim I wherein the contacting is carried out in the essential absence of emulsion formation.

28. The method of claim 1 wherein the treated crude contains naphthenate salts of the corresponding Group IA and Group IIA metals.

* * * * *